US008801382B2

(12) United States Patent
Garin et al.

(10) Patent No.: US 8,801,382 B2
(45) Date of Patent: Aug. 12, 2014

(54) ROTOR FOR TURBOMACHINERY

(75) Inventors: Fabrice Marcel Noël Garin, Bertrand (FR); Romain Nicolas Lunel, Jard (FR)

(73) Assignees: Snecma, Paris (FR); Herakles, Le Haillan (FR)

( * ) Notice: Subject to any disclaimer, the term of this patent is extended or adjusted under 35 U.S.C. 154(b) by 503 days.

(21) Appl. No.: 13/267,290

(22) Filed: Oct. 6, 2011

(65) Prior Publication Data

US 2012/0087795 A1 Apr. 12, 2012

(30) Foreign Application Priority Data

Oct. 6, 2010 (FR) ..... 10 58112

(51) Int. Cl.
*F01D 5/22* (2006.01)
*F01D 11/00* (2006.01)

(52) U.S. Cl.
CPC ..... *F01D 11/008* (2013.01); *F05D 2240/80* (2013.01)
USPC ..... 416/193 A; 416/220 R

(58) Field of Classification Search
USPC ..... 415/193 A, 204 A, 219 R, 220 R, 244 R, 415/244 A
See application file for complete search history.

(56) References Cited

U.S. PATENT DOCUMENTS

| | | | | |
|---|---|---|---|---|
| 4,604,033 | A * | 8/1986 | Surdi | 416/220 R |
| 5,049,035 | A * | 9/1991 | Marlin | 416/193 A |
| 5,161,949 | A * | 11/1992 | Brioude et al. | 416/193 A |
| 8,277,190 | B2 * | 10/2012 | Piersall et al. | 416/219 R |

FOREIGN PATENT DOCUMENTS

| | | |
|---|---|---|
| EP | 1 306 523 A1 | 5/2003 |
| FR | 2 608 674 | 6/1988 |

* cited by examiner

*Primary Examiner* — Igor Kershteyn
(74) *Attorney, Agent, or Firm* — Pillsbury Winthrop Shaw Pittman LLP

(57) ABSTRACT

A rotor includes a disc, on which are fixed vanes, and platforms between these vanes. The rotor is particularly remarkable in that the platforms are fixed securely and tightly to the disc. To this end, the disc includes between two successive vanes an upstream stop projecting axially from the upstream surface, and each platform includes: a plate, a retaining groove extending axially and in which the upstream stop of the disc is engaged, an axial stop bearing axially against the upstream surface of the disc.

9 Claims, 2 Drawing Sheets

ROTOR FOR TURBOMACHINERY

CROSS-REFERENCE TO RELATED APPLICATIONS

This application claims the benefit of priority from French Patent Application No. 1058112, filed on Oct. 6, 2010, the entire content of which is incorporated herein by reference.

FIELD

The present invention relates to a rotor for turbomachinery having inserted platforms, in particular a rotor intended for a turbojet engine fan or an aeronautical engine compression stage. More specifically, the invention relates to a rotor for an aeronautical engine high-pressure or low-pressure turbine stage. The invention also relates to a turbomachine comprising such a rotor, as well as a platform for such a rotor.

BACKGROUND

In order to facilitate assembly and disassembly of the rotor, in particular in the event of failure, it is known to form the platforms and vanes separately from one another and to assemble them on the disc. Document FR2608674 thus describes a rotor for turbomachinery which comprises a disc provided with cavities in which the feet of the vanes are inserted, as well as wedges on which the platforms are fixed.

Likewise, document EP1306523 describes a rotor comprising a disc provided with cavities, in which both the vanes and platforms are fixed.

However, the fixing of both the vanes and the platforms in the cavities in the disc may lead to jamming of the vanes. Furthermore, having a plurality of parts in the cavities produces additional tolerances and therefore increases play in the cavity, which may lead to a risk of premature wear and an increased risk of jamming of the vane.

In addition, in the rotors of the prior art, gases may infiltrate between the platforms and the disc, in particular in the vicinity of the cavities in the disc, which damages the disc.

SUMMARY

Embodiments of the present invention relates to a rotor, for example a fan rotor or turbomachine compressor rotor or high-pressure or low-pressure turbine rotor comprising a disc, a set of radial vanes mounted in axial seats formed in the periphery of said disc, and a set of platforms which form an annular vein in which the gases passing through the turbine circulate.

An aspect of the invention is to overcome, at least in part, the drawbacks of the prior art by proposing a rotor in which the platforms are fixed without adversely affecting the fixing of the vanes on the disc.

A further aspect of the invention is to propose a rotor in which the platforms are fixed more securely.

A further aspect of the invention is to propose a rotor which has better sealing in the vicinity of the platforms and which makes it possible to reduce the risk of infiltration of gases between the platforms and the disc.

In order to do this, in accordance with a first aspect of the invention, a rotor for turbomachinery is proposed, comprising:

- a disc having rotational symmetry about a reference axis, the disc comprising an upstream surface extending radially and a peripheral surface extending substantially parallel to the reference axis, the peripheral surface comprising a downstream edge,
- a plurality of vanes fixed to the disc,
- a plurality of platforms, each platform being disposed between two successive vanes, the disc comprising, between two successive vanes, an upstream stop projecting axially from the upstream surface, each platform comprising:

- a plate,
- a retaining groove extending axially and in which the upstream stop of the disc is engaged,
- an axial stop bearing axially against the upstream surface of the disc.

The rotor according to an embodiment of the invention is thus particularly remarkable in that the platforms are not fixed to the vanes or in the cavities of the disk which contain the vanes, but they are fixed directly to the disc, in particular as a result of a retaining groove and an axial stop.

The rotor according to the first aspect of the invention may also have one or more of the features below, considered in isolation or in any technically feasible combination.

Beneficially, the retaining groove is formed between a radially higher wall of the axial stop and the radially lower wall of an upstream radial stop fixed to the platform.

Beneficially, the platform comprises a downstream radial stop which engages in a retaining slot in the disc.

Beneficially, the downstream radial stop of the platform and/or the upstream radial stop of the platform belong to a retaining lug of the platform, the retaining lug extending axially and bearing radially against the peripheral surface of the disc.

In accordance with an embodiment of the invention, the rotor further comprises a flange bearing axially against the axial stop of each platform. This flange makes, it possible to keep the axial stops pressed against the upstream surface of the disc. In addition, this flange makes it possible to guarantee the seal between the platform and the disc and makes it possible in particular to avoid infiltrations of hot air inside the disc, which makes it possible to not heat the interior of the disc.

In order to facilitate comprehension of the invention, the two vanes between which each platform is disposed are called the "first vane" and the "second vane".

Beneficially, the plate of each platform comprises a first lateral edge which marries the first vane and a second lateral edge which marries the second vane. The seal is thus perfect between the plate of each platform and the two vanes between which the platform is disposed, in such a way that the platforms tightly define the aerodynamic vein of circulation of gases passing through the turbine. These gases thus cannot infiltrate between the platforms and the disc. The system fixing the platforms to the disc also makes it possible to improve this seal since the platforms are prevented from moving in their seats.

In accordance with different embodiments:

- the platforms may be formed of a metal material, which makes it possible to obtain more resistant platforms, or
- the platforms can be formed of a ceramic matrix composite material, which makes it possible to increase weight.

In fact, having platforms inserted independently of the vanes makes it possible to select the material of the platforms independently of that of the vanes.

More specifically, an embodiment of the invention relates to the case in which the vanes are formed of a ceramic matrix composite material.

More specifically, an embodiment of the invention relates to the case in which the vanes are fixed in the cavities formed in the peripheral surface of the disc.

Beneficially, the vanes extend radially.

Beneficially, the vanes are distributed over the periphery of the disc.

Beneficially, the disc is made of a metal material.

In accordance with an embodiment, the plate and retaining lug are formed by a transverse wall extending radially.

A second aspect of the invention relates to a platform for a rotor according to the first aspect of the invention.

A third aspect of the invention relates to a turbomachine comprising a rotor according to the first aspect of the invention.

BRIEF DESCRIPTION OF THE FIGURES

Further features and benefits of the invention will become clear on reading the detailed description below, with reference to the accompanying drawings, in which.

For greater clarity, identical or similar elements are indicated by identical reference signs in all figures.

DETAILED DESCRIPTION

Figure 1:
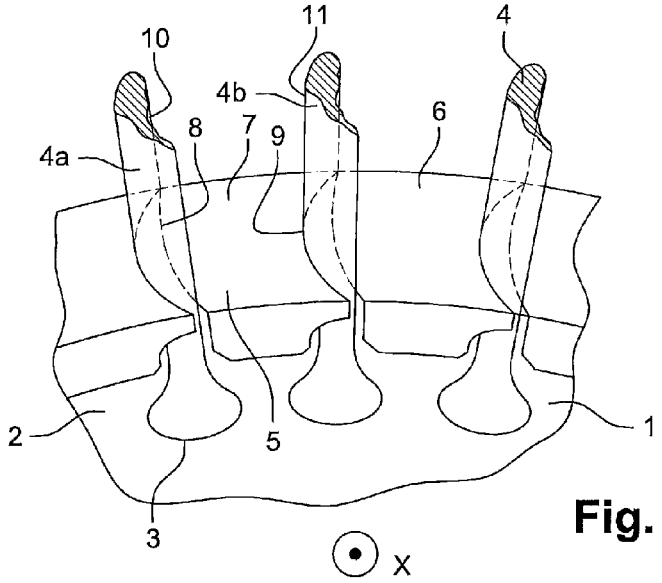
FIG. 1 is a schematic perspective view of a rotor portion according to one embodiment of the invention.
Figure 2:
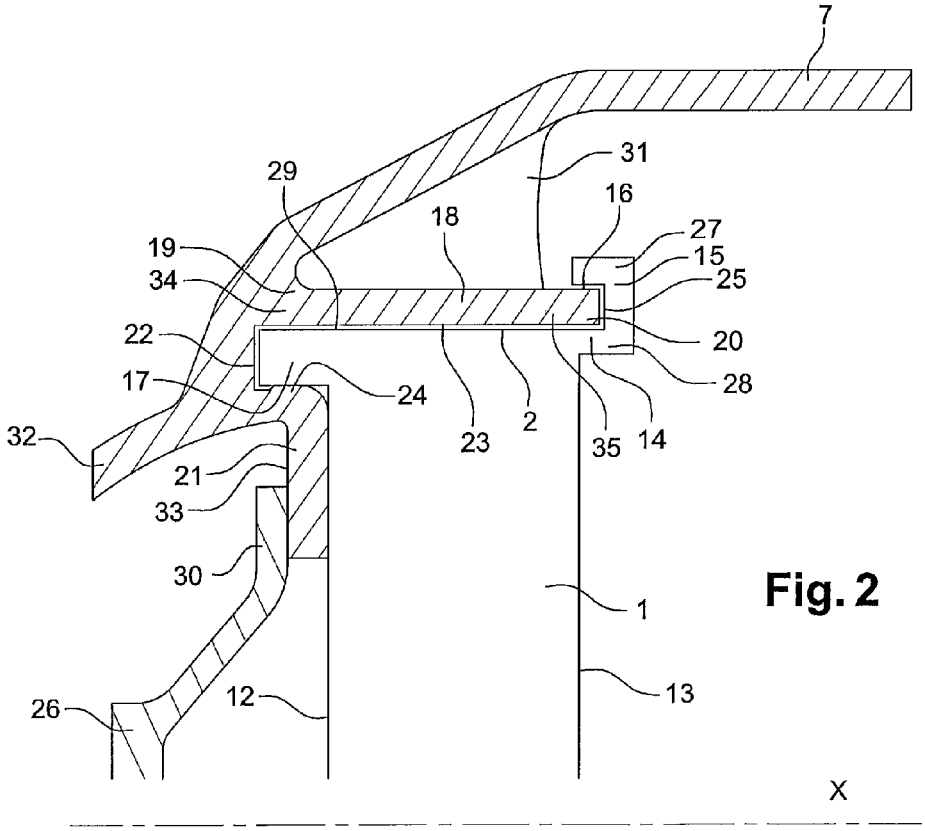
FIG. 2 is a schematic sectional view in a plane passing through the reference axis of the rotor of FIG. 1.
Figure 3:
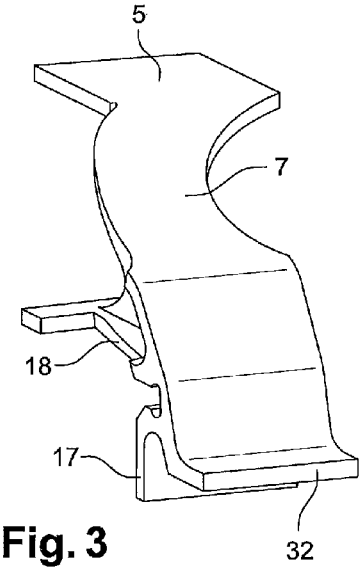
FIG. 3 is a perspective view of a platform of the rotor of FIG. 1.
Figure 4:
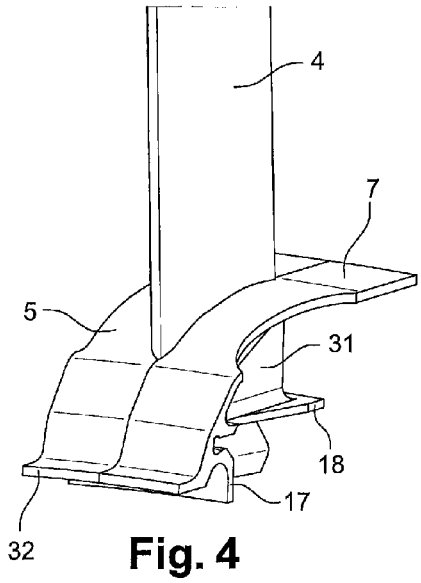
FIG. 4 is a perspective view of a blade of the rotor of FIG. 1 surrounded by two blades.
Figure 5:
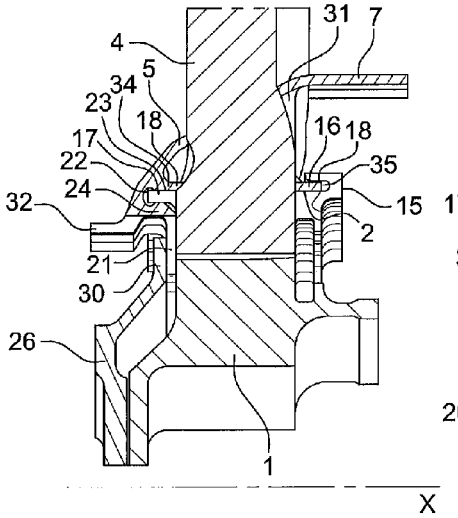
FIG. 5 is a sectional view in another plan passing through the reference axis of the rotor of FIG. 1.
Figure 6:
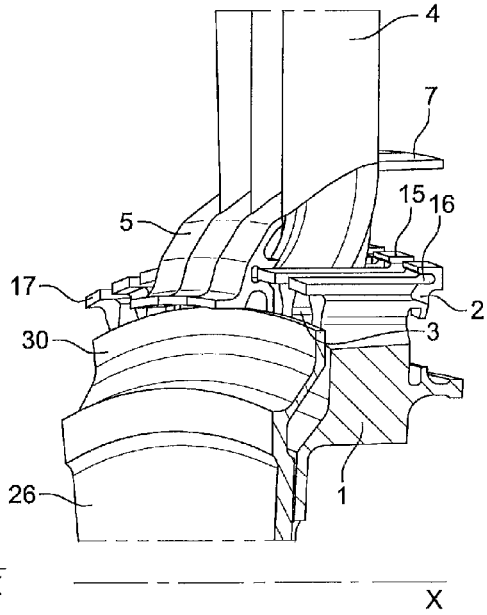
FIG. 6 is a perspective view of a portion of the rotor of FIG. 1.

FIGS. 1 to 6 show a turbomachine rotor according to an embodiment of the invention. This rotor comprises a disc 1. This disc 1 has rotational symmetry about a reference axis X. More specifically, this disc 1 is cylindrical about the reference axis X. The disc 1 is formed in an embodiment of a metal material, for example a nickel-chromium alloy, which for example has the following composition:

| | Ni | Cr | Fe | Mo | Nb | Co | Mn | Cu | Al | Ti | Si | C | S | P | B |
|---|---|---|---|---|---|---|---|---|---|---|---|---|---|---|---|
| Mass percentage | 50.0-55.0 | 17.0-21.0 | qsf 100% | 2.80-3.30 | 4.75-5.50 | 1.0 max | 0.35 max | 0.30 max | 0.20-0.80 | 0.65 1.15 | 0.35 max | 0.08 max | 0.015 max | 0.015 max | 0.006 max |

This nickel-chromium alloy is known by the trade name Inconel 718.

The disc 1 has a cylindrical peripheral surface 2 about the reference axis X. The peripheral surface extends parallel to the reference axis X. Cavities 3 are formed in the peripheral surface 2. A vane 4 is fixed in each cavity 3. The method for fixing the vanes 4 in the cavities 3 is known from the prior art. In an embodiment, the vanes 4 are formed of a ceramic matrix composite material. The vanes 4 are distributed over the periphery of the disc 1.

The rotor according to an embodiment of the invention also comprises platforms 5. Each platform 5 is disposed between two successive vanes 4. Each platform 5 comprises a plate 7 which has an outer surface 6. The outer surfaces 6 of the plates 7 of the platforms define the inner profile of the upstream vein of gases circulating upstream, downstream of the vane stage 4. Each platform 5 also makes it possible to maintain the spacing between two adjacent vanes 4.

For this reason, the plate 7 of each platform 5 comprises a first lateral edge 8 and a second lateral edge 9. The first lateral edge 8 is also known as the "extrados" edge and the second lateral edge 9 is also known as the "intrados" edge. The first lateral edge 8 marries the shape of the wall 10 of the vane 4*a* against which it is arranged, and the second lateral edge 9 marries the shape of the wall 11 of the vane 4*b* against which it is arranged. The vane 4*a* against which the first edge of the platform 5 is arranged is called the "first vane". The vane 4*b* against which the second edge of the platform 5 is arranged is called the "second vane". Furthermore, as is seen more clearly in FIGS. 3 and 4, the plate 7 is rounded so as to have an aerodynamic profile in order to guide the fluids which pass over its surface.

The method for fixing each platform 5 on the disc 1 will now be described in greater detail with reference to the figures. The disc 1 also comprises; in addition to the peripheral surface 2, an upstream surface 12 and a downstream surface 13. The disc 1 comprises a downstream edge 14 at the intersection between the peripheral surface 2 and the downstream surface 12.

Between two successive vanes, for example between the vanes 4*a* and 4*b*, the disc 1 comprises a hook 15 fixed to the downstream edge 14. This hook 15 is arranged so as to form, with the peripheral surface 2, a retaining slot 16 which extends axially. The retaining slot 16 is open in the upstream direction and closed by the hook 15 in the downstream direction.

The hook 15 comprises a base 25 which extends radially and which axially closes the retaining slot 16. The hook 15 also comprises an upper wall 27 which extends axially and which is parallel to the peripheral surface 2 of the disc. The retaining slot 16 is thus defined radially by the upper wall 27 and by the peripheral surface 2. Furthermore, the hook 15 may also comprise a lower wall 28 which axially extends, the peripheral surface 2 beyond the downstream edge 14. However, this lower wall 28 is optional.

Furthermore, between two successive vanes 4*a* and 4*b* the disc 1 comprises an upstream stop 17 projecting axially from the upstream surface 12. In an embodiment, the upstream stop 17 has an upper surface 29 which is in the extension of the peripheral surface 2 of the disc.

In an embodiment, the disc 1 is formed of a single piece. The disc 1 is thus formed in a single metal block in which the hook 15 and the upstream stop 17 are machined, which makes it possible to achieve greater precision.

In an embodiment, each platform 5 comprises a downstream radial stop 35 which engages in the retaining slot 16 of the disc. This downstream radial stop 35 is formed by a downstream end 20 of a retaining lug 18 of the platform 5. The retaining lug 18 extends substantially parallel to the reference axis X. The retaining lug 18 forms an acute angle with, the plate 7. The retaining lug 18 bears radially on the peripheral surface 2 of the disc 1, and its downstream end 20, which forms the downstream radial stop 35, is inserted into the retaining slot 16 in the disc.

Each platform 5 also comprises an axial stop 21 which extends radially. The axial stop 21 thus extends substantially perpendicular to the retaining lug 18. The axial stop 21 is shaped so as to bear axially against the upstream surface 12 of the disc when the downstream end 20 of the retaining lug 18 is inserted into the retaining slot 16, and more precisely when the retaining lug 18 axially bears against the base 25 of the retaining slot 16.

Each platform 5 also comprises a retaining groove 22. The retaining groove 22 extends substantially parallel to the reference axis X. The retaining groove 22 is formed between a radially upper wall 24 of the axial stop 21 and the radially lower wall 23 of an upstream radial stop 34 fixed to the platform 5. The retaining groove 22 is positioned between the retaining lug 18 and the axial stop 21. The upstream radial stop 34 is formed by the upstream end 19 of the retaining lug 18. The retaining groove 22 and the upstream stop 17 are shaped so that the upstream stop 17 axially bears on the base of the retaining groove 22 when the retaining lug 18 axially bears on the base of the retaining slot 16.

Furthermore, the upstream stop 17 has outer radial dimensions substantially equal to the inner radial dimensions of the retaining groove 22 so as to radially immobilise the platform 5 in relation to the disc 1.

Likewise, the retaining lug 18 has outer radial dimensions substantially equal to the inner radial dimensions of the retaining slot 16 so as to radially immobilise the retaining lug 18 in relation to the disc 1.

An embodiment of the invention is thus particularly remarkable in that the platforms are fixed to the disc, on the surface of the disc, and therefore above cavities in which the vanes are fixed, which makes it possible to achieve more secure fixing of these elements on the disc. Furthermore, fixing the platforms using the peripheral surface and the upstream surface of the disc makes it possible not to weaken the disc and to achieve a very precise positioning of the platforms in relation to the disc.

Furthermore, not having an intermediate piece between the disc and each platform makes it possible to obtain a reduced chain of dimensions and therefore better precision in the positioning of the platforms, which makes it possible to improve the seal between the platforms and the disc.

The rotor according to an embodiment of the invention also comprises a flange 26 which has rotational symmetry about the reference axis X. The flange 26 has an annular wall 30 bearing axially against the axial stop 21 of the platform 5. This flange 26 makes it possible to keep the axial stop 21 pressed axially against the upstream surface 12. Furthermore, this flange 26 makes it possible to guarantee the seal between the platform 5 and the disc 1 and in particular makes it possible to avoid infiltrations of hot air inside the disc, which makes it possible to cool the interior of the disc.

In order to guarantee a perfect seal, the flange 26 comprises an annular wall 30 which is flat and bears against the outer wall 33 of the axial stop 21, which is also flat.

Furthermore, each platform 5 may also comprise a transverse wall 31 which connects the retaining lug 18 to the plate 7 so as to increase the sturdiness of the platform 5.

The platform 5 may be formed of a ceramic matrix composite material or a metal material.

Each platform 5 may also comprise a return 32 which extends the plate 7 upstream of the plate 7. In an embodiment, this return 32 is positioned above the flange 26 and allows the platform 5 to have a more aerodynamic profile.

Embodiments of the invention therefore make it possible to provide inserted platforms which are securely fixed, without complicating or weakening the disc or adding independent, additional fixing parts.

Furthermore, embodiments of the invention make it possible to improve the seal of the portion positioned between the disc and the platforms and make it possible to avoid infiltrations of gas in said portion.

What is claimed is:

1. A rotor for turbomachinery, comprising:

a disc having rotational symmetry about reference axis, the disc comprising an upstream surface extending radially and a peripheral surface extending substantially parallel to the reference axis, the peripheral surface comprising a downstream edge, a plurality of vanes fixed to the disc, a plurality of platforms, each platform being disposed between two successive vanes, the disc comprising, between two successive vanes, an upstream stop projecting axially from the upstream surface, each platform comprising:

a plate, a retaining groove extending axially and in which the upstream stop of the disc is engaged, an axial stop bearing axially against the upstream surface of the disc.

2. The rotor according to claim 1, wherein the retaining groove is formed between a radially upper wall of the axial stop and the radially lower wall of an upstream radial stop fixed to the platform.

3. The rotor according to claim 1, wherein the platform comprises a downstream radial stop which engages in a retaining slot in the disc.

4. The rotor according to claim 2, wherein a downstream radial stop of the platform which engages in a retaining slot in the disc and/or the upstream radial stop of the platform belong to a retaining lug of the platform, the retaining lug extending axially and bearing radially against the peripheral surface of the disc.

5. The rotor according to claim 1, comprising a flange bearing axially against the axial stop of each platform.

6. The rotor according to claim 1, wherein the platforms are formed of a metal material.

7. The rotor according to claim 1, wherein the platforms are formed of a ceramic matrix composite material.

8. The rotor according to claim 1, wherein the vanes are formed of a ceramic matrix composite material.

9. A turbomachine comprising a rotor according claim 1.

* * * * *